US010486894B2

(12) United States Patent
Rudolf

(10) Patent No.: US 10,486,894 B2
(45) Date of Patent: Nov. 26, 2019

(54) CONTAINER WITH A BEVELLED EDGE AND AN ADJACENT TRANSVERSE CURVED EDGE

(71) Applicant: PHILIP MORRIS PRODUCTS S.A., Neuchatel (CH)

(72) Inventor: David Rudolf, Kutna Hora (CZ)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/760,396

(22) PCT Filed: Sep. 16, 2016

(86) PCT No.: PCT/EP2016/072033
§ 371 (c)(1),
(2) Date: Mar. 15, 2018

(87) PCT Pub. No.: WO2017/046364
PCT Pub. Date: Mar. 23, 2017

(65) Prior Publication Data

US 2018/0257848 A1 Sep. 13, 2018

(30) Foreign Application Priority Data

Sep. 17, 2015 (EP) ..... 15185752

(51) Int. Cl.
*B65D 85/10* (2006.01)
*B65D 5/42* (2006.01)
*B65D 5/02* (2006.01)

(52) U.S. Cl.
CPC ..... *B65D 85/1045* (2013.01); *B65D 5/0209* (2013.01); *B65D 5/4266* (2013.01)

(58) Field of Classification Search
CPC ..... B65D 85/1045; B65D 5/0209; B65D 5/4266; B65D 85/10; A24F 15/00
(Continued)

(56) References Cited

U.S. PATENT DOCUMENTS 5,435,440 A * 7/1995 Focke ..... B65D 5/6691 206/265
5,896,984 A * 4/1999 Focke ..... B65D 85/1045 206/268

(Continued)

FOREIGN PATENT DOCUMENTS

AU 2002244715 8/2002
CA 2437936 2/2002

(Continued)

OTHER PUBLICATIONS

PCT Search Report and Written Opinion for PCT/EP2016/072033 dated Oct. 14, 2016 (9 pages).

(Continued)

*Primary Examiner* — Christopher R Demeree
(74) *Attorney, Agent, or Firm* — Mueting, Raasch & Gebhardt, P.A.

(57) ABSTRACT

A container for consumer goods and a laminar blank (300) for forming such a container. The laminar blank defines a portion of the container, which comprises: a first planar wall (322); a second planar wall (314) connected to the first planar wall (322) by a first modified edge portion (3140) forming a bevelled edge portion of the container; and a third planar wall (316) connected to the first planar wall (322) by a second modified edge portion (3130) forming a curved edge portion of the container. The longitudinal direction of the first modified edge portion (3140) being transverse to the longitudinal direction of the second modified edge portion (3130); the first modified edge portion (3140) and the second modified edge portion (3130) forming, when the container is assembled from the laminar blank, adjacent edge portions of the container meeting at a junction.

15 Claims, 5 Drawing Sheets

(58) Field of Classification Search
USPC ..... 229/198.2, 160.1, 182.1, 930; 206/268, 206/242
See application file for complete search history.

(56) References Cited

U.S. PATENT DOCUMENTS

| | | | | |
|---|---|---|---|---|
| 5,924,627 | A * | 7/1999 | Wilder | B65D 5/4266 229/182.1 |
| 6,276,600 | B1 * | 8/2001 | Rigby | B65D 85/1045 206/273 |
| 6,343,691 | B1 | 2/2002 | Focke | |
| 7,370,756 | B2 | 5/2008 | Bray | |
| 7,456,711 | B1 | 12/2008 | Tambo | |
| 7,896,225 | B2 * | 3/2011 | Bray | B65D 85/1063 206/242 |
| D635,851 | S * | 4/2011 | Pipes | D9/433 |
| 8,608,051 | B2 * | 12/2013 | Focke | B65D 5/029 206/259 |
| 8,800,761 | B2 * | 8/2014 | Lutzig | B65D 5/18 206/268 |
| 10,059,505 | B2 * | 8/2018 | Tanbo | B65D 5/4266 |
| 2004/0144661 | A1 * | 7/2004 | Lutzig | B65D 5/6691 206/268 |
| 2004/0178089 | A1 * | 9/2004 | Draghetti | B65D 85/1045 206/242 |
| 2005/0029131 | A1 * | 2/2005 | Draghetti | B65D 85/1045 206/259 |
| 2006/0006078 | A1 * | 1/2006 | Vaccari | B65D 5/4279 206/273 |
| 2013/0319886 | A1 | 12/2013 | Ledermann | |
| 2018/0186504 | A1 * | 7/2018 | Rudolf | B65D 5/4266 |

FOREIGN PATENT DOCUMENTS

| | | |
|---|---|---|
| CN | 1052639 | 9/1992 |
| CN | 1142459 | 7/2002 |
| CN | 1496326 | 5/2004 |
| CN | 1822995 | 8/2006 |
| CN | 101200236 | 6/2013 |
| CN | 103269954 | 8/2016 |
| CN | 104884356 | 5/2017 |
| CN | 104540742 | 7/2017 |
| DE | 10106548 | 8/2002 |
| EP | 0745541 | 12/1996 |
| EP | 0764595 | 5/2003 |
| EP | 1645527 | 4/2006 |
| EP | 2022729 | 2/2009 |
| WO | WO 2017/001615 | 1/2017 |
| WO | WO 2017/021342 | 2/2017 |

OTHER PUBLICATIONS

European Extended Search Report for Application No. 15185752.1 dated Dec. 16, 2015 (7 pages).
Office Action issued in China for Application No. 201680049916.3 dated Mar. 14, 2019 (12 pages). English translation included.

* cited by examiner

CONTAINER WITH A BEVELLED EDGE AND AN ADJACENT TRANSVERSE CURVED EDGE

This application is a U.S. National Stage Application of International Application No. PCT/EP2016/072033, filed Sep. 16, 2016, which was published in English on Mar. 23, 2017, as International Publication No. WO 2017/046364 A1. International Application No. PCT/EP2016/072033 claims priority to European Application No. 15185752.1 filed Sep. 17, 2015.

The present invention relates to a container for consumer goods and to a blank for forming such container, which find particular application for holding consumer goods, such as smoking articles (for example cigarettes).

Smoking articles such as cigarettes and cigars are usually provided in soft-pack packs or hard-pack packs, such as flip-top boxes or hinge-lid boxes. These typically have a box part having a box front wall, a box rear wall, box side walls and a box base. They also usually have a lid part with a lid front wall, a lid rear wall, lid side walls and a lid top side. The lid part is typically hinged to the box part along a hinge line extending across a back wall of the container. The hinge line is usually provided as a pre-folded line, a crease line or a score line.

For hard-pack packs, it is known to round off or chamfer certain corners of the box and lid to give the container a distinctive appearance. This has typically been achieved in the past by providing creasing lines or score lines in the blank at the areas forming the edges of the container. These lines allow the blank to be folded in such a way that the corner does not sharply bend but instead progressively bends between two adjacent walls.

However, where a container comprises adjacent rounded or bevelled edges forming an angle, such as an orthogonal angle, the strength and finish of the container may at times be impacted during folding of the blank to form the container. In some cases, a hole or gap can even be formed at the junction between the adjacent rounded or bevelled edges. Thus, not only is the visual and tactile perception of the container impacted, but also the container may be structurally damaged.

Thus, it would be desirable to provide a container for consumer goods that is less prone to being damaged during the assembly operation and that has an improved look and a smoother feel. In particular, it would be desirable that one such container be easy to assemble using standard packing apparatus and techniques, without the requirement for significant changes to existing machines and methods. At the same time, it would be desirable to provide a blank for manufacturing a container for consumer goods that makes the production and assembly process easier, more flexible and less likely to cause damages in the assembled container. Furthermore, it would be desirable to provide a container having a bevelled edge portion that is transverse to an adjacent curved edge portion, where it is difficult (if not impossible) for a consumer to see a hole or gap at the junction between said edge portions in the assembled container.

According to a first aspect of the present invention, there is provided: a container for consumer articles, the container being at least partially formed from a laminar blank. The laminar blank defines a portion of the container, which comprises: a first planar wall; a second planar wall connected to the first planar wall by a first modified edge portion forming a bevelled edge portion of the container; and a third planar wall connected to the first planar wall by a second modified edge portion forming a curved edge portion of the container. The longitudinal direction of the first modified edge portion being transverse to the longitudinal direction of the second modified edge portion; the first modified edge portion and the second modified edge portion forming, when the container is assembled from the laminar blank, adjacent edge portions of the container meeting at a junction. Each of the first modified edge portion and the second modified edge portion has a length in the longitudinal direction of the respective modified edge portion and a respective width that extends transversely to the length. The first modified edge portion has a perimeter, the perimeter comprising: a first line of weakness and a second line of weakness each extending in the longitudinal direction of the first modified edge portion, and a free edge extending between the tip of the first line of weakness and the tip of the second line of weakness at the junction with the second modified edge portion. The second modified edge portion has a perimeter, the perimeter comprising: a first line of weakness and a second line of weakness each extending in the longitudinal direction of the second modified edge portion, and a free edge extending between the tip of the first line of weakness and the tip of the second line of weakness at the junction with the first modified edge portion.

Preferably, the free edge of at least one of the first modified edge portion and the second modified edge portion comprises a curved free edge portion and a straight free edge portion.

According to a second aspect of the present invention, there is provided a laminar blank for forming a container for consumer articles, the laminar blank defines a portion of the container, which comprises: a first planar wall; a second planar wall connected to the first planar wall by a first modified edge portion forming a bevelled edge portion of the container; and a third planar wall connected to the first planar wall by a second modified edge portion forming a curved edge portion of the container. The longitudinal direction of the first modified edge portion being transverse to the longitudinal direction of the second modified edge portion; the first modified edge portion and the second modified edge portion forming, when the container is assembled from the laminar blank, adjacent edge portions of the container meeting at a junction. Each of the first modified edge portion and the second modified edge portion has a length in the longitudinal direction of the respective modified edge portion and a respective width that extends transversely to the length. The first modified edge portion has a perimeter, the perimeter comprising: a first line of weakness and a second line of weakness each extending in the longitudinal direction of the first modified edge portion, and a free edge extending between the tip of the first line of weakness and the tip of the second line of weakness at the junction with the second modified edge portion. The second modified edge portion has a perimeter, the perimeter comprising: a first line of weakness and a second line of weakness each extending in the longitudinal direction of the second modified edge portion, and a free edge extending between the tip of the first line of weakness and the tip of the second line of weakness at the junction with the first modified edge portion.

Preferably, the free edge of at least one of the first modified edge portion and the second modified edge portion comprises a curved free edge portion and a straight free edge portion.

It shall be appreciated that any features described with reference to one aspect of the present invention are equally applicable to any other aspect of the invention.

In contrast to known blanks/containers having two adjacent non-squared (for example, rounded or bevelled) modified edge portions, the present invention relates to a laminar blank and a container formed from a laminar blank where the free edges of adjacent modified edge portion have been configured in a way that reduces the risk of holes or gaps forming in the container during assembly. In particular, the present invention relates to a container having a bevelled edge portion that is transverse to an adjacent rounded edge portion, and where the free edges of said edge portions at the junction between said edge portions are configured to trace each other's profile when the container is assembled, such that it is difficult (if not impossible) for a consumer to see a hole or gap between said free edges in the assembled container. The present inventor has therefore identified that, in the particular case of containers having a bevelled edge portion and an adjacent transverse curved edge portion, arranging for said free edges of the container to have certain features can greatly assist in achieving this objective.

For example, preferably the free edge of the first modified edge portion comprises a first curved free edge portion, and the free edge of the second modified edge portion comprises a second curved free edge portion. In such embodiments, preferably the first curved free edge portion of the first modified edge portion has a centre of curvature that is located on the same side of the junction as the centre of curvature of the first curved free edge portion of the second modified edge portion. Arranging for the two curved free edge portion's centre of curvature to be located on the same side of the junction, can allow said free edge portions to trace each other's profile when the container is assembled, such that it is difficult (if not impossible) for a consumer to see a hole or gap between the free edges in the assembled container.

Furthermore, preferably, the free edge of at least one of the first modified edge portion and the second modified edge portion comprises a curved free edge portion and a straight free edge portion.

For example, in a first set of preferred embodiments including the embodiment shown in FIGS. 4*a* and 4*b*, the free edge of the first modified edge portion comprises a first curved free edge portion and a straight free edge portion. Preferably, the straight free edge portion extends from the first line of weakness of the first modified edge portion, and the curved free edge portion extends from the straight free edge portion. Preferably, the first line of weakness of the first modified edge portion comprises a straight portion and a curved portion. Preferably, the curved portion of the first line of weakness defines the tip of the first line of weakness.

In the first set of preferred embodiments, preferably the free edge of the second modified edge portion comprises a first curved free edge portion having a centre of curvature that is located on the same side of the junction as the centre of curvature of the first curved free edge portion of the first modified edge portion. This can allow said curved free edge portions to trace each other's profile when the container is assembled, such that it is difficult (if not impossible) for a consumer to see a hole or gap between the free edges in the assembled container. Furthermore, preferably, the free edge of the second modified edge portion further comprises a second curved free edge portion, the second curved free edge portion having a centre of curvature that is located on the opposite side of the junction to the location of the centre of curvature of the first curved free edge portion of the first modified edge portion, and the location of the centre of curvature of the first curved free edge portion of the second modified edge portion. In such preferred embodiments, this can result in the free edge of the second modified edge portion having a substantially s-shaped profile. The present inventor has identified that such as substantially s-shaped profile can complement the curved and straight free edge portions of the first modified edge portion, and thus make it difficult (if not impossible) for a consumer to see a hole or gap between the free edges in the assembled container.

In a second set of preferred embodiments including the embodiment shown in FIG. 5, the free edge of the second modified edge portion comprises a first curved free edge portion and a straight free edge portion. In such embodiments, preferably the straight free edge portion extends from the second line of weakness of the second modified edge portion, and the curved free edge portion extends from the straight free edge portion. In the second set of preferred embodiments, preferably, each of the first line of weakness and the second line of weakness of the first modified edge portion is substantially straight. In such embodiments, preferably the free edge of the first modified edge portion comprises a first curved free edge portion extending from the tip of the first line of weakness to the tip of the second line of weakness. In such embodiments, preferably the first curved free edge portion of the first modified edge portion has a centre of curvature that is located on the same side of the junction as the centre of curvature of the first curved free edge portion of the second modified edge portion. The present inventor has identified that such preferred features for the second set of embodiments, can help said free edge portions trace each other's profile when the container is assembled, such that it is difficult (if not impossible) for a consumer to see a hole or gap between the free edges in the assembled container.

The term "modified edge portion" is used herein to refer in particular to an edge portion of the container having a non-square shape as viewed in cross-section, or to a portion of a laminar blank, which when folded, will form an edge portion of the container having a non-square shape as viewed in cross-section. This may for example refer to a "curved edge portion", that is an edge portion of the container having an arc-like shape as viewed in cross-section. By the term "arc-like" reference is made to any non-straight line, including circular arc, parabolic arc, hyperbolic arc, or elliptical arc. Further, this may for example refer to a "bevelled edge portion", that is an edge portion of the container that has, as viewed in cross-section, a substantially straight shape forming an angle between 0 and 90 degrees with the adjacent walls of the container.

The term "creasing line" is used herein to refer to a line along the laminar blank that has been mechanically deformed, for example by mechanical pressing or rolling, to form a line of weakness in the blank about which the blank can be folded. In particular, the line of weakness is formed without removing material.

The term "extending substantially in the longitudinal direction of the modified edge portion" is used here in to mean that the creasing line or the ablation line extends from a first point of the modified edge portion to a second point of the modified edge portion that together lie on an imaginary straight line that forms an angle of less than 20 degrees with the longitudinal direction of the modified edge portion.

The expression "distance between creasing lines in a pair of creasing lines" is used to describe the width of the portion of the modified edge portion that resides between two creasing lines in a single pair of creasing lines. Such distance is construed as being measured along the width of the modified edge portion and between the respective symmetry axes of the creasing lines. In practice, because the creasing lines extend along the length of the modified edge portion, the distance between adjacent creasing lines in a single pair is measured substantially perpendicular to the lines themselves.

The expression "distance between adjacent pairs of creasing lines" is used to describe the width of the portion of modified edge portion separating two adjacent pairs of creasing lines. Such distance is construed as being measured along the width of the modified edge portion. In practice, because the creasing lines extend along the length of the modified edge portion, the distance between adjacent pairs of creasing lines is measured substantially perpendicular to the main axis of the creasing lines.

The term "proximate to" is used throughout this specification to describe a pair of creasing lines immediately adjacent another element of the container, such as a planar wall thereof. In practice, in some embodiments, one of the creasing lines of a first pair adjacent a first planar wall of the container extends substantially at the border between the planar wall of the container and the modified edge portion connecting the planar wall to another planar wall of the container.

The term "inner surface" is used throughout the specification to refer to the side of a portion of the blank that, once the container is assembled, faces towards the interior of the container, for example towards the consumer goods, when the container is closed. Thus, the inner surface is not directly visible for the consumer when the container is closed. The term "outer surface" is used throughout the specification to refer to the side of a portion of the blank that, once the container is assembled, faces towards the exterior of the container.

The term "ablation area" is used herein to refer to the minimum area of the blank that encloses all ablated lines on a modified edge portion.

The term "ablated line" is used herein to refer to an area of a modified edge portion from which material has been ablated (for example, removed by means of a laser beam or a blade) from a surface of the laminar blank or container. Accordingly, the residual thickness of an ablated line is less than the thickness (T) of the laminar blank. Preferably, an ablated line is provided as a groove within the blank. This may be formed with a linear ablation tool, such as a laser or a blade. In embodiments where all the ablated lines are defined by parallel grooves within the blank, the area of the ablation area may be regarded as the area enclosing all the grooves on a modified edge portion. Thus, in those embodiments, the width of the ablation area may be regarded as extending transversely to the grooves, from the first to the last of the grooves on a modified edge portion.

The term "residual thickness" is used herein to refer to the minimum distance measured between two opposite surfaces of the laminar blank or of a wall of the container formed from the blank. In practice, the distance at a given location is measured along a direction locally perpendicular to the opposite surfaces. The "residual thickness" of an ablated line may be constant over the ablated line if material is removed homogenously substantially all over the ablated line (flat profile). Alternatively, the residual thickness of the ablated line may vary across a width of the ablated line, if material is removed non-homogeneously over the ablated line (e.g. V-shaped, U-shaped grooves).

As used herein, the terms "front", "back", "upper", "lower", "top", "bottom" and "side", refer to the relative positions of portions of containers according to the invention and components thereof when the container is in an upright position with the access opening at the top of the container. In particular, where the container is a hinged lid container, this refers to the container being in an upright position with the lid in the closed position and the hinge line at the back of the container. When describing containers according to the present invention, these terms are used irrespective of the orientation of the container being described.

The term "spring-back force" is a known term of art for referring to a particular property of a laminar blank. It is sometimes referred to as 'the crease recovery' and means the force (N) required to hold a scored sample that is folded at 90 degrees for a 15-second period. The measurement is made at the end of the 15-second period. The spring-back force of a portion of a laminar blank can be measured using a known PIRA Crease and Board Stiffness Tester (commercially available for example from Messmer and Buchel, UK). As is known in the art, to measure the spring-back force of a modified edge portion of a container, a sample of the portion to be tested should first be removed from the laminar blank. For round corner packs, for the purposes of the present invention the spring-back force of a pack is assessed using a sample measuring 38±1 millimeters by 38±0.5 millimeters, with the corner forming portion being positioned 21±0.5 millimeters from one side of the blank. The blank should be conditioned at 22 degrees Celsius and 60 percent relative humidity for at least 24 hours prior to testing.

In preferred embodiments, the second modified edge portion further comprises a plurality of additional lines of weakness disposed between the first line of weakness and the second line of weakness of the second modified edge portion, the plurality of additional lines of weakness extending substantially in the longitudinal direction of the second modified edge portion. Preferably, the plurality of additional lines of weakness of the second modified edge portion comprise a third line of weakness, and the free edge of the second modified edge portion extends from the third line of weakness. In such embodiments, preferably the third line of weakness of the second modified edge portion is disposed adjacent to the first line of weakness of the second modified edge portion. In such embodiments, preferably the tip of the third line of weakness of the second modified edge portion abuts the tip of the second line of weakness of the first modified edge portion.

As set out in more detail below, the lines of weakness may be formed as one or more creasing lines in the laminar blank. Alternatively or additionally, the lines of weakness may take the form of one or more ablated lines on the inner surface of the laminar blank.

In some preferred embodiments, the lines of weakness of the first modified edge portion are a plurality of ablated lines on the inner surface of said modified edge portion.

Alternatively or additionally, in some preferred embodiments, the lines of weakness of the second modified edge portion are a plurality of creasing lines in the laminar blank.

In some particularly preferred embodiments, the second modified edge portion is defined by a plurality of creasing lines in the laminar blank. Preferably, the plurality of creasing lines extend in the longitudinal direction of the second modified edge portion over the whole length of the second modified edge portion. In such embodiments, the plurality of creasing lines preferably extend in parallel in the longitudinal direction of the second modified edge portion over the whole length of the second modified edge portion. This enhances the definition of a curved edge portion defined by the creasing lines. The greater the number of creasing lines and greater the density of creasing lines, the more the edge portion will form a curved shape when the container is assembled. Accordingly, in some preferred embodiments, the second modified edge portion is defined by at least four creasing lines in the laminar blank, the at least four creasing lines extending in the longitudinal direction of the second modified edge portion over the whole length of the second modified edge portion. Advantageously by forming the second modified edge portion from a plurality of creasing lines, the second modified edge portion can be formed using existing machinery and techniques. For example, if the second modified edge portion forms a longitudinal edge portion of the container—such as one disposed between a side wall and a front wall or rear wall of the container—then said longitudinal edge portion can be formed by machinery and techniques that are already utilized for conventional round corner or beveled edge containers.

As noted above, in some embodiments, both the first modified edge portion and the second modified edge portion may each be respectively defined by a plurality of creasing lines in the laminar blank. However, in some preferred embodiments, one of the first modified edge portion or the second modified edge portion is instead defined by a plurality of ablated lines on the inner surface of said modified edge portion.

In some particularly preferred embodiments, the second modified edge portion is defined by a plurality of creasing lines in the laminar blank, and the first modified edge portion has an inner surface defining an ablation area that comprises one or more ablated lines each having a residual thickness less than the thickness (T) of the laminar blank. Such arrangements can advantageously allow the second modified edge portion to be formed using existing creasing machinery and techniques, whilst adopting advantages (such as flexibility of design) associated with ablation technology, for forming the first modified edge portion.

Preferably, the ablation area of the first modified edge portion comprises a first ablated line and a second ablated line extending in parallel in the longitudinal direction of the first modified edge portion within the first portion of the ablation area; and wherein each of the first and second ablated lines is arranged proximate to a respective one of the first planar wall and the second planar wall.

Advantages associated with ablation technology, such as flexibility of design, can therefore be utilized to form the potentially more complex shape of the first modified edge portion, whilst still utilizing existing creasing machinery and techniques for forming the second modified edge portion.

As noted above, utilising one or more ablated lines to define the first modified edge portion provides several advantages. For example, because the outer surface of the blank is unaffected by the ablation process, the resulting outer surface of the container about the first modified edge portion is smooth upon visual and tactile inspection on the part of the consumer. Further, because this smooth surface can be obtained with a relatively small number of ablated lines, and therefore with limited material removal, the strength of the container at the rounded or beveled edge portion may be adjusted, so that appearance and resistance of the container are both advantageously improved.

Advantageously, the blank may be manufactured by precisely removing material from the round corner portion with a linear ablation tool (e.g. laser, blade). Repeated passages of the ablation tool over a given portion of the blank results in the controlled removal of a greater percentage of material, that is in a reduced residual thickness.

Furthermore, as the blank is bent into shape at the first modified edge portion, a portion of the total deflection is absorbed by each reduced thickness ablated line, so that the resulting container edge advantageously gets to assume the desired shape more smoothly than it would be if it were formed with sharp creases. The weakness created in the blank by the ablated lines allows such a precise shape to be formed without needing any or major adjustment of the bending forces that are applied to the planar walls of the blank that are connected by the modified edge portion. Accordingly, whilst the first modified edge portion may be defined by ablated lines that may themselves need to be created using non-conventional techniques, the actual act of folding the blank about said edge portion, does not itself need to be greatly adjusted (if at all), and consequently containers according to the present invention can still be easily assembled on conventional packing machinery.

Where a modified edge portion is defined by one or more ablation lines on the inner surface of said modified edge portion, preferably, each of the ablation lines has a residual thickness of at least about 5 percent of the thickness (T) of the blank. More preferably, each of the ablation lines has a residual thickness of at least about 10 percent of the thickness (T) of the blank. Even more preferably, each of the ablation lines has a residual thickness of at least about 20 percent of the thickness (T) of the blank. In addition, or as an alternative, each of the ablation lines has preferably a residual thickness of less than about 50 percent of the thickness (T) of the blank. More preferably, each of the ablation lines has a residual thickness of less than about 40 percent of the thickness (T) of the blank. Even more preferably, each of the ablation lines has preferably a residual thickness of less than about 30 percent of the thickness (T) of the blank. In some particularly preferred embodiments, each of the ablation lines has preferably a residual thickness of about 20 percent of the thickness (T) of the blank.

Where a modified edge portion is defined by one or more ablation lines on the inner surface of said modified edge portion, preferably, the ablated width of each ablated line is at least about 0.01 millimeters. More preferably, the ablated width of each ablated line is at least about 0.05 millimeters. In addition, or as an alternative, the ablated width of each ablated line is less than about 0.4 millimeters. More preferably, the ablated width of each ablated line is less than about 0.2 millimeters. In some preferred embodiments, the ablated width of each ablated line is from about 0.01 millimeters to about 0.4 millimeters. Even more preferably, the ablated width of each ablated line is from about 0.05 millimeters to 0.2 millimeters.

Preferably, the container has a spring-back force of less than about 10 milliNewton meters between the two planar walls that are connected by a modified edge portion. Preferably, the blank has a spring-back force of less than about 10 milliNewton meters between two planar walls that are connected by a modified edge portion, more preferably less than about 9 milliNewton meters, even more preferably less than about 7 milliNewton meters. Preferably, the blank has a spring-back force of at least about 3 milliNewton meters between two planar walls that are connected by a modified edge portion, more preferably at least about 4 milliNewton meters.

In some preferred embodiments, the second modified edge portion is defined by a plurality of creasing lines in the laminar blank. In such embodiments, the plurality of creasing lines comprises a plurality of pairs of creasing lines, all the creasing lines extending in parallel in the longitudinal direction of the second modified edge portion, wherein the distance (X) between two creasing lines in each pair as measured along the width (W) of the modified edge portion is less than the distance (Y) between two adjacent pairs of creasing lines as measured along the width (W) of the modified edge portion.

Surprisingly, it has been found that such an arrangement of creasing lines, when forming a rounded edge portion of a container, is easier, and may result in the formation of an outer surface of the container that is smoother upon visual and tactile inspection on the part of the consumer. Further, the rounded edge portion of the container effectively approximates the theoretical, reference rounded shape with a relatively small number of creasing lines. Thus, at the same time, the strength of the container at the rounded edges may be better preserved.

Preferably, the distance (X) between two creasing lines in each pair is less than about 1 millimeter. More preferably, the distance (X) between two creasing lines in each pair is less than about 0.8 millimeters. In addition, the distance (X) between two creasing lines in each pair is preferably at least about 0.4 millimeters. More preferably, the distance (X) between two creasing lines in each pair is preferably at least about 0.6 millimeters.

Preferably, the distance (Y) between two adjacent pairs of creasing lines is less than about 1.2 millimeters. More preferably, the distance (Y) between two adjacent pairs of creasing lines is less than about 1 millimeter. In addition, or as an alternative, the distance (Y) between two adjacent pairs of creasing lines is at least about 0.6 millimeters. More preferably, the distance (Y) between two adjacent pairs of creasing lines is at least about 0.8 millimeters.

Without wishing to be bound by theory, it has been identified that a particular ratio of the distance (X) between two creasing lines in each pair, with respect to the distance (Y) between two adjacent pairs of creasing lines can provide particularly smooth looking round corner portions, with relatively few creasing lines. In particular, preferably the distance (X) between two creasing lines in each pair is between about 70 percent and about 85 percent of the distance (Y) between two adjacent pairs of creasing lines, more preferably between about 75 percent and about 80 percent of the distance (Y) between two adjacent pairs of creasing lines.

In some preferred embodiments, the second modified edge portion comprises at least a first pair of creasing lines proximate to the first planar wall and a second pair of creasing lines proximate to the third planar wall.

In some alternative embodiments, the modified edge portion comprises a first single creasing line and a second single creasing line adjoining the first planar wall and the third planar wall, respectively. Further, the modified edge portion comprises at least a first pair of creasing lines and a second pair of creasing lines extending between the first and the second single creasing line. The distance (Z1) between the first pair of creasing lines and the first single creasing line or the distance (Z2) between the second pair of creasing lines and the second single creasing line or both is greater than the distance (X) between two creasing lines in each pair as measured along the width (W) of the modified edge portion. Preferably, the distance (Z1) between the first pair of creasing lines and the first single creasing line is substantially equal to the distance (Z2) between the second pair of creasing lines and the second single creasing line.

The distance (Z1) between the first pair of creasing lines and the first single creasing line is preferably at least about 0.6 millimeters, more preferably at least 0.8 millimeters. Preferably, the distance (Z1) between the first pair of creasing line and the first single creasing line is less than about 1.2 millimeters.

Preferably, each creasing line has a width (CW) of at least about 0.05 millimeters, more preferably of at least about 0.1 millimeters, even more preferably of at least about 0.2 millimeters. In addition, or as an alternative, each creasing line has a width (CW) of less than about 0.6 millimeters, preferably less than about 0.5 millimeters, preferably less than about 0.4 millimeters, preferably less than about 0.3 millimeters, even more preferably less than about 0.2 millimeters. In some preferred embodiments, each creasing line has a width (CW) of from about 0.05 millimeters to about 0.4 millimeters, more preferably of from about 0.1 to about 0.3 millimeters.

Blanks according to the present invention find application for the manufacture of containers for consumer goods, in particular elongate consumer goods such as smoking articles. However, they can also be used for several other types of consumer goods, such as confectionary. In particular, a container may be formed from a blank according to the present invention, wherein the laminar blank forms at least a part of the container comprising a box portion having a box front wall, a box rear wall and box side walls extending between the box front wall and the box rear wall, and wherein the modified edge portions connect at least one of the box front wall and the box rear wall to the box side walls. As an alternative, a container may be formed from a blank according to the present invention, wherein the laminar blank forms at least a part of the container comprising a lid portion having a lid front wall, a lid rear wall and lid side walls extending between the lid front wall and the lid rear wall, and wherein the modified edge portions connect at least one of the lid front wall and the lid rear wall to the lid side walls.

Blanks according to the present invention may be formed from any suitable material or combination of materials, including, but not limited to, cardboard, paperboard, plastic, metal, or combinations thereof. Preferably, the blank is a laminar cardboard blank having a weight of between about 100 grams per square meter and about 350 grams per square meter. In preferred embodiments, the blank has a thickness of from about 200 to about 400 micrometers, more preferably from 250 micrometers to 350 micrometers.

A container formed from a blank according to the present invention may optionally comprise an outer wrapper, which is preferably a transparent polymeric film of, for example, high or low density polyethylene, polypropylene, oriented polypropylene, polyvinylidene chloride, cellulose film, or combinations thereof and the outer wrapper is applied in a conventional manner. The outer wrapper may include a tear tape. In addition, the outer wrapper may be printed with images, consumer information or other data.

Further, the consumer articles may be provided within one such container in the form of a bundle wrapped in an inner package formed of metal foil or metallised paper. The inner package material may be formed as a laminate of a metallised polyethylene film, and a liner material. The liner material may be a super-calendered glassine paper. In addition, the inner package material may be provided with a print-receptive top coating. The inner package has an access opening through which consumer goods can be removed when a lid of the container is in a respective open position.

The blank is preferably for forming a rectangular parallelepiped container comprising two wider walls spaced apart by two narrower walls. A hinge lid container formable from a blank according to the container shall typically comprise two longitudinal rounded or bevelled edges on the front wall, and/or two longitudinal rounded or bevelled edges on the back wall. These may optionally be in combination with one or more rounded or bevelled transverse edges.

Where the container comprises bevelled edges, preferably the bevelled edges have a width of between about 1 mm and about 10 mm, preferably between about 2 and about 6 mm.

Containers according to the invention find particular application as packs for elongate smoking articles such as, for example, cigarettes, cigars or cigarillos. It will be appreciated that through appropriate choices of the dimensions thereof, containers according to the invention may be designed for different numbers of conventional size, king size, super-king size, slim or super-slim cigarettes. Alternatively, other consumer goods may be housed inside the container.

Through an appropriate choice of the dimensions, containers according to the invention may be designed to hold different total numbers of smoking articles, or different arrangements of smoking articles. For example, through an appropriate choice of the dimensions, containers according to the invention may be designed to hold a total of between ten and thirty smoking articles. The smoking articles may be arranged in different collations, depending on the total number of smoking articles. Containers formed from blanks according to the present invention may hold smoking articles of the same type or brand, or of different types or brands. In addition, both filter-less smoking articles and smoking articles with various filter tips may be contained, as well as smoking articles of differing length (for example, between about 40 mm and about 180 mm), diameter (for example, between about 4 mm and about 9 mm). Preferably, the dimensions of the container are adapted to the length of the smoking articles, and the collation of the smoking articles. Typically, the outer dimensions of the container are between about 0.5 mm to about 5 mm larger than the dimensions of the bundle or bundles of smoking articles housed inside the container. The length, width and depth of containers according to the invention may be such that the resultant overall dimensions of the container are similar to the dimensions of a typical disposable pack of twenty cigarettes.

Thus, it shall be appreciated that the total number and the arrangement of the smoking articles within the container shall generally directly impact the maximum width and depth of the container and, correspondingly the geometric features of certain blanks according to the invention as described above. In particular, in certain preferred embodiments, the size of the side portions of the dust flaps can be selected such as to ensure that the container can accommodate a predetermined number of smoking articles in a given arrangement. Accordingly, the skilled person shall appreciate how the present invention provides a valuable and versatile tool for designing and manufacturing containers suitable to receive substantially any number of smoking articles in any given arrangement.

Preferably, containers according to the invention have a height of between about 60 mm and about 150 mm, more preferably a height of between about 70 mm and about 125 mm, wherein the height is measured from the bottom wall to the top wall of the container.

Preferably, containers according to the invention have a width of between about 12 mm and about 150 mm, more preferably a width of between about 70 mm and about 125 mm, wherein the width is measured from one side wall to the other side wall of the container.

Preferably, containers according to the invention have a depth of between about 6 mm and about 150 mm, more preferably a depth of between about 12 mm and about 25 mm wherein the depth is measured from the front wall to the back wall of the container.

Preferably, the ratio of the height of the container to the depth of the container is in between about 0.3 to 1 and about 10 to 1, more preferably between about 2 to 1 and about 8 to 1, most preferably between about 3 to 1 and 5 to 1

Preferably, the ratio of the width of the container to the depth of the container is in between about 0.3 to 1 and about 10 to 1, more preferably between about 2 to 1 and about 8 to 1, most preferably between about 2 to 1 and 3 to 1.

Preferably, the ratio of the height of the lid back wall to the height of the box back wall of the outer sleeve is between about 0 to 1 (lid located at the top edge of the container) to about 1 to 1, more preferably, between about 1 to 5 and about 1 to 10, most preferably, between about 1 to 6 to about 1 to 8.

Preferably, the ratio of the height of the lid front wall of the outer sleeve to the height of the box front wall of the outer sleeve is between about 1 to 0 (lid covering the entire front wall) to about 1 to 10, more preferably, between about 1 to 1 and about 1 to 5, most preferably, between about 1 to 2 and about 1 to 3.

The surfaces of blanks according to the invention which correspond to exterior surfaces of containers may be printed, embossed, debossed or otherwise embellished with manufacturer or brand logos, trade marks, slogans and other consumer information and indicia.

Containers according to the present invention may hold smoking articles of the same type or brand, or of different types or brands. In addition, both filter-less smoking articles and smoking articles with various filter tips may be contained, as well as smoking articles of differing length (for example, between about 40 mm and about 180 mm), diameter (for example, between about 4 mm and about 9 mm). Preferably, the dimensions of the container are adapted to the length of the smoking articles, and the collation of the smoking articles. Typically, the outer dimensions of the container are between about 0.5 mm to about 5 mm larger than the dimensions of the bundle or bundles of smoking articles housed inside the container.

The length, width and depth of containers according to the invention may be such that the resultant overall dimensions of the container are similar to the dimensions of a typical disposable pack of twenty cigarettes.

Preferably, containers according to the invention have a height of between about 60 mm and about 150 mm, more preferably a height of between about 70 mm and about 125 mm, wherein the height is measured from the bottom wall to the top wall of the container.

Preferably, containers according to the invention have a width of between about 12 mm and about 150 mm, more preferably a width of between about 70 mm and about 125 mm, wherein the width is measured from one side wall to the other side wall of the container.

Preferably, containers according to the invention have a depth of between about 6 mm and about 150 mm, more preferably a depth of between about 12 mm and about 25 mm wherein the depth is measured from the front wall to the back wall of the container.

Preferably, the ratio of the height of the container to the depth of the container is in between about 0.3 to 1 and about 10 to 1, more preferably between about 2 to 1 and about 8 to 1, most preferably between about 3 to 1 and 5 to 1

Preferably, the ratio of the width of the container to the depth of the container is in between about 0.3 to 1 and about 10 to 1, more preferably between about 2 to 1 and about 8 to 1, most preferably between about 2 to 1 and 3 to 1.

Preferably, the ratio of the height of the lid back wall to the height of the box back wall of the outer sleeve is between about 0 to 1 (lid located at the top edge of the container) to about 1 to 1, more preferably, between about 1 to 5 and about 1 to 10, most preferably, between about 1 to 6 to about 1 to 8.

Preferably, the ratio of the height of the lid front wall of the outer sleeve to the height of the box front wall of the outer sleeve is between about 1 to 0 (lid covering the entire front wall) to about 1 to 10, more preferably, between about 1 to 1 and about 1 to 5, most preferably, between about 1 to 2 and about 1 to 3.

The exterior surfaces of containers according to the invention may be printed, embossed, debossed or otherwise embellished with manufacturer or brand logos, trade marks, slogans and other consumer information and indicia.

Containers according to the invention may be filled and assembled using conventional apparatus and methods, modified to include the step of forming one or more creasing lines in the blank, and optionally, the step of forming one or more ablated lines in the blank. The ablated lines may be produced using an ablation tool, such as a laser or a blade. A laser is particularly preferred as the ablation tool as it can allow for a wide variety of ablation profiles and configurations, with minimal adjustment of the laser tool being needed. For example, the laser may be repeatedly passed over a given portion of the blank to iteratively remove different amounts of material, allowing for a very finely controlled ablation profile. This is particularly beneficial if the fine ablated lines are required, with narrow widths. It is possible to accurately control the relative movement of the laser and the blank so as to form any type of pattern with varying removal intensity ("depth") over the ablation area.

The invention will be further described, by way of example only, with reference to the accompanying drawings in which:

FIG. 3 is a view of a cardboard laminar blank 300 for forming a container for consumer goods according to the invention.

Figure 1:
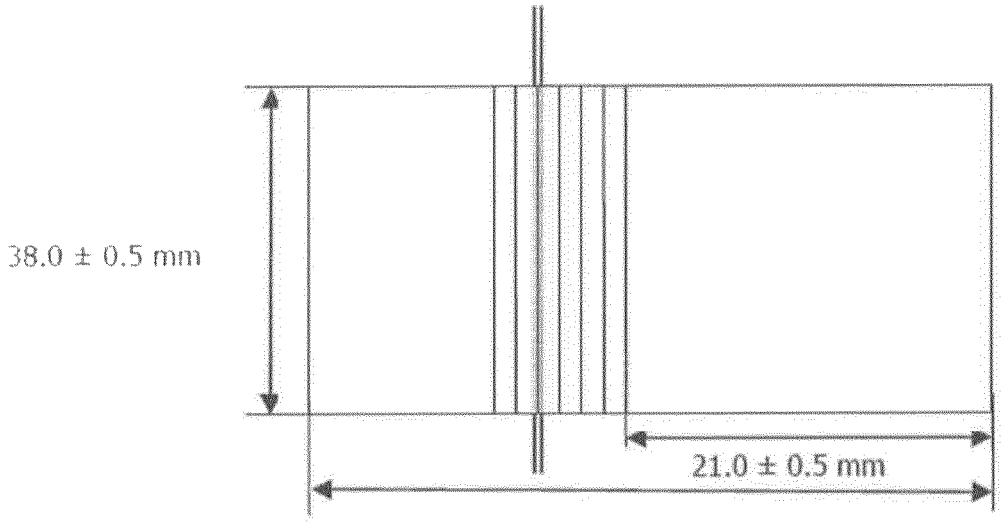
FIG. 1 depicts a sample portion of a laminar blank for use in determining the spring-back force of the blank.
Figure 2:
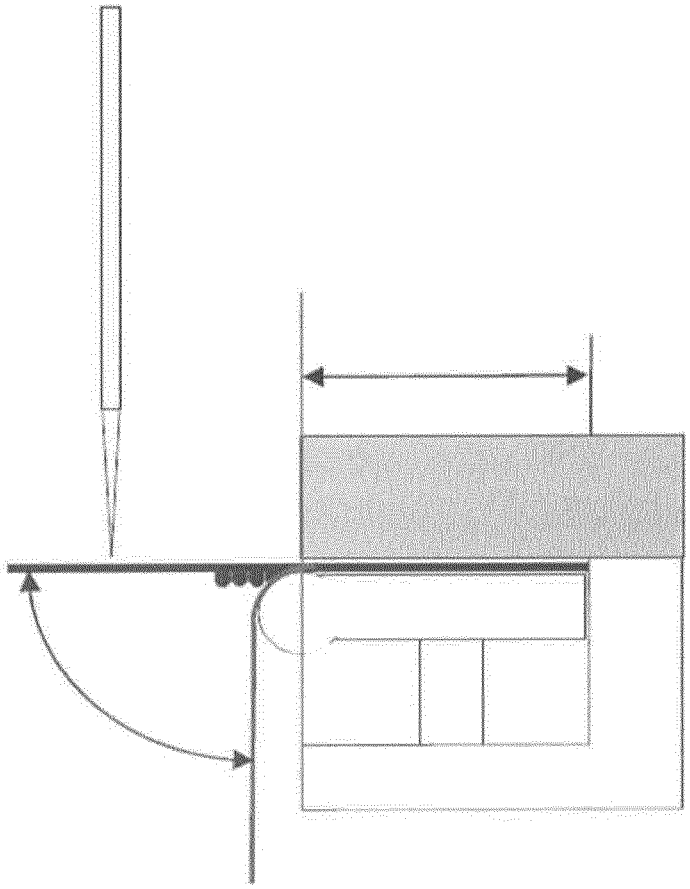
FIG. 2 depicts an apparatus for determining the spring-back force of a blank.

The blank 300 comprises a box blank portion 3001 for forming a box portion of the container, and a lid blank portion 3002 for forming a lid portion of the container. The box blank portion 3001 depends from the lid blank portion 3002 along hinge line 3003.

The box blank portion 3001 comprises a front wall panel 308, a rear wall panel 312 and a bottom wall panel 309. Two side wall panels 310 extend from front wall panel 308, two side wall panels 311 extend from rear wall panel 312, and two box dust flaps 313 extend from side wall panels 311. When the box portion of the container is assembled from the box blank portion 3001, the front wall panel 308 forms the container front wall, the rear wall panel 312 forms the container rear wall, the side wall panels 310, 311 overlap to form left and right side container walls, and the box dust flaps 313 overlap the bottom wall panel 309 to form the container bottom wall. The side wall panels 310, 311 are substantially the same size and shape as each other. When the container is formed, the side wall panels 310, 311 directly overlie each other with their free edges substantially aligned, such that the inner side wall panel is barely visible. The box dust flaps 313 are smaller than the bottom wall panel 309. When the container is formed, the box dust flaps 313 lie inside the bottom wall panel 309. They provide additional structural support for the container bottom wall of the container but are not visible from the outside of the container.

The lid blank portion 3002 comprises a front wall panel 322, a rear wall panel 320 and a top wall panel 314. Two side wall panels 316 extend from the front wall panel 322, two side wall panels 317 extend from the rear wall panel 320, and lid dust flaps 319 extend from the side wall panels 317. When the lid portion of the container is assembled from the lid blank portion 3002, the front wall panel 322 forms the container front wall, the rear wall panel 320 forms the container rear wall, the side wall panels 316,317 overlap to form right and left container side walls, and the lid dust flaps 319 overlap top wall panel 314 to form the lid top wall. The side wall panels 316, 317 are substantially the same size and shape as each other. When the container is formed, the panels 316, 317 directly overlie each other with their free edges substantially aligned, such that the inner side wall panel is barely visible from the exterior of the container. The lid dust flaps 319 are smaller than the top wall panel 314. When the container is formed, the lid dust flaps 319 lie inside the top wall panel 314. They provide additional structural support for the container (lid) top wall, but are not visible from the outside of the container.

Figure 3:
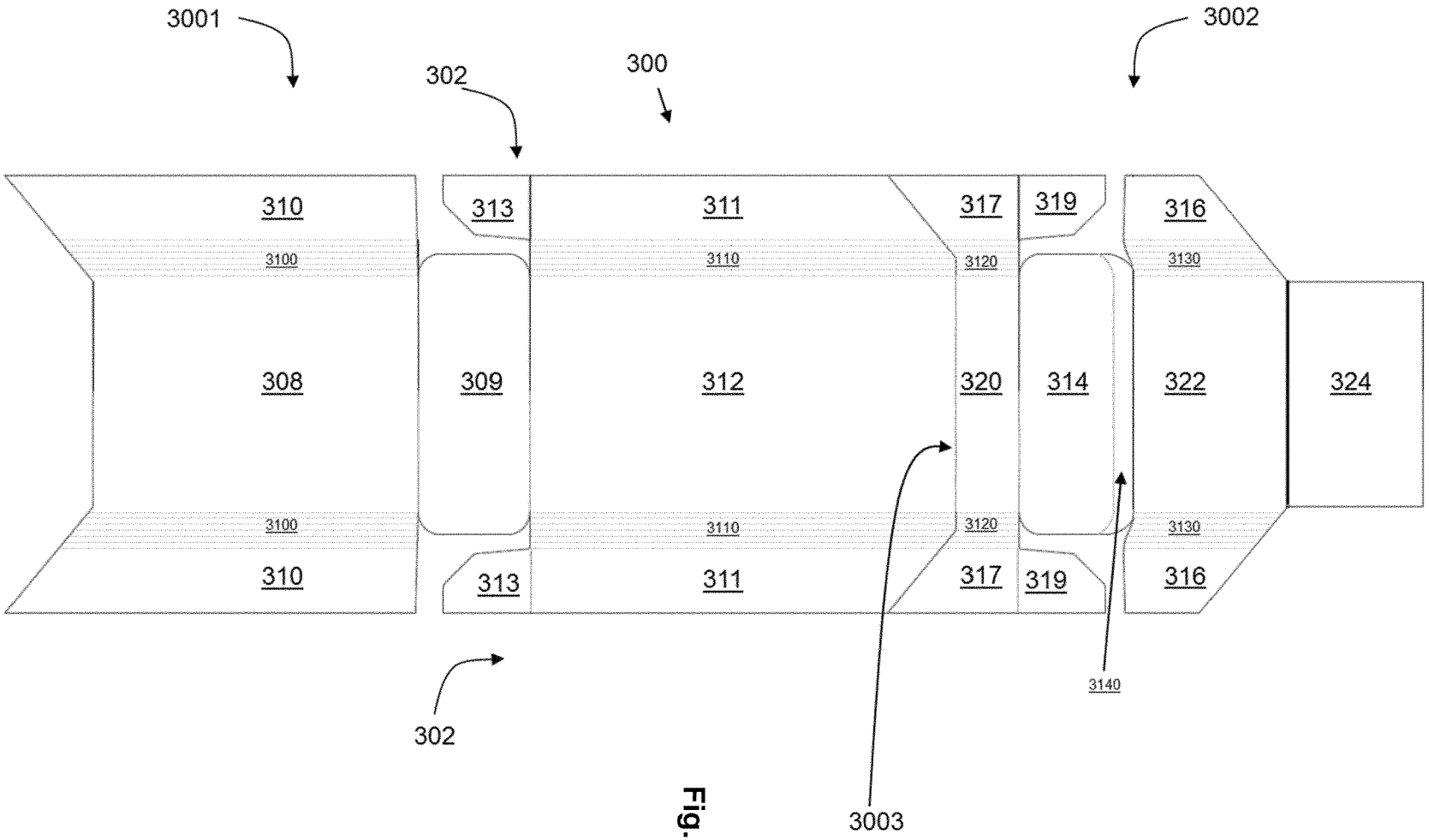
FIG. 3 shows a schematic top view of a laminar blank for the manufacture of a container in accordance with a first embodiment of the present invention.

The side panels 310, 311, 317 and 316 are connected by modified edge portions 3100, 3110, 3120 and 3130 to front wall panel 308, the rear wall panel 312, front rear wall panel 320, and front wall panel 322, respectively. Each of the modified edge portions 3100, 3110, 3120 and 3130 has an inner and an outer surface. In the embodiment shown in FIG. 3, the modified edge portions 3100, 3110, 3120 and 3130 each comprise seven creasing lines extending in parallel in the longitudinal direction of their respective modified edge portion 3100, 3110, 3120 and 3130. Consequently, when the laminar blank 300 is folded about the modified edge portions 3100, 3110, 3120 and 3130 a curved edge portion is formed on the container between the walls connected by the modified edge portions 3100, 3110, 3120 and 3130. It will be appreciated that the modified edge portions 3100, 3110, 3120 and 3130 could alternatively each comprise seven ablated lines extending in parallel in the longitudinal direction of their respective modified edge portion 3100, 3110, 3120 and 3130, where material had been ablated from the inner surface of the modified edge portions 3100, 3110, 3120 and 3130, for example by a laser ablation tool.

The top wall panel 314 is connected to the lid front wall panel 322 by a modified edge portion 3140. As can be best seen in the enlarged views of the laminar blank 300 in FIGS. 4A and 4B, the modified edge portion 3410 meets the modified edge portion 3130 at a junction.

Figure 4A:
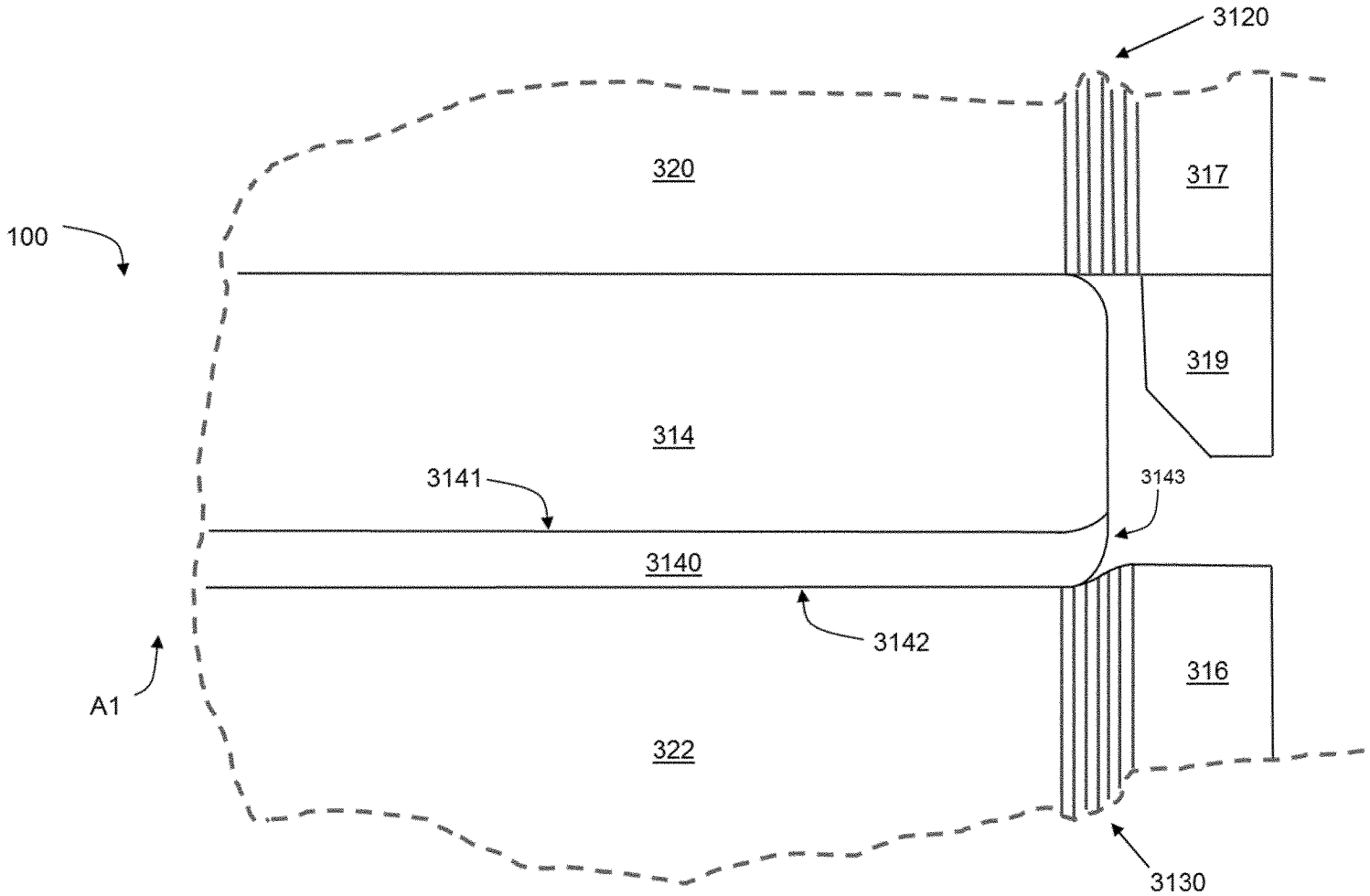
FIG. 4A shows a magnified view of a portion of the laminar blank of FIG. 3.
Figure 4B:
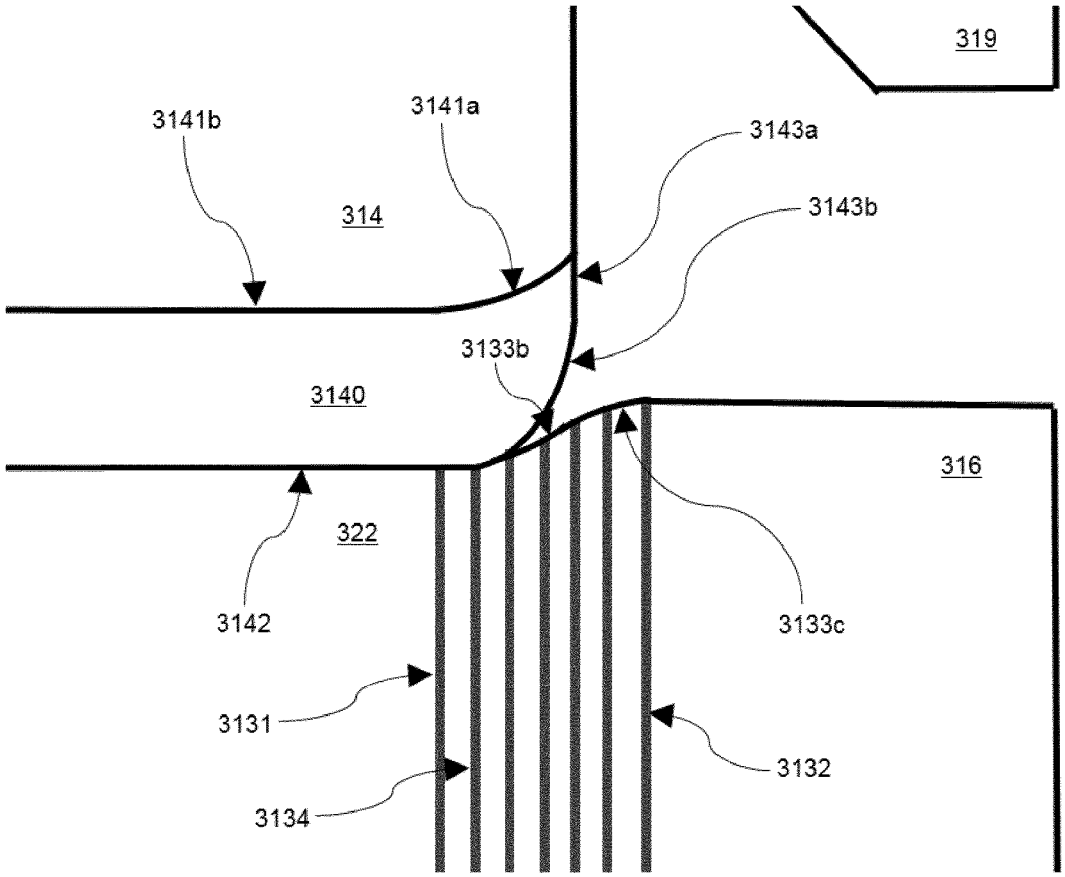
FIG. 4B shows a further magnified view of the portion of the laminar blank shown in FIG. 4A.

With reference to FIGS. 4A and 4B, the modified edge portion 3410 is defined by a first line of weakness 3141 in the form of a first ablated line 3141 and a second line of weakness in the form of a second ablated line 3142. That is, the perimeter of the modified edge portion 3140 comprises the first ablated line 3141, the second ablated line 3142 and a free edge 3143 that extends between the tip of the first ablated line 3141 and the tip of the second ablated line 3142 at the junction with the modified edge portion 3130. Not all of the perimeter of the modified edge portion 3410 is shown in FIG. 4A or 4B.

When the laminar blank 300 is folded about the modified edge portion 3140 a bevelled edge portion is formed on the container between the top wall of the container formed by top wall panel 314 and the lid front wall of the container formed by lid front wall panel 322.

As best seen in FIG. 4B, the free edge 3143 has a curved free edge portion 3143*b* and a straight free edge portion 3143*a*. The curved free edge portion 3143*b* extends from the tip of the second ablated line 3142, and the straight free edge portion 3143*a* extends from the tip of the first ablated line 3141. The first ablated line 3141 has a curved portion 3141*a* that defines the tip of the first ablated line 3141, and a straight portion 3141*b* that extends from the curved portion 3141*a* of the first ablated line 3141. The second ablated line 3142 is straight.

Modified edge portion 3130 has a perimeter comprising a first creasing line 3131, a second creasing line 3132, and a free edge 3133 that extends between the tip of the first creasing line 3131 and the tip of the second creasing line 3132 at the junction with the modified edge portion 3140. Not all of the perimeter of the modified edge portion 3410 is shown in FIG. 4A or 4B. The free edge 3133 of modified edge portion 3130 comprises a first curved free edge portion 3133*b* having a centre of curvature that is located on the same side of the junction as the centre of curvature of the first curved free edge portion 3143*b* of the modified edge portion 3140. Furthermore, the free edge 3133 of the modified edge portion 3130 further comprises a second curved free edge portion 3133*c*, the second curved free edge portion 3133*c* having a centre of curvature that is located on the opposite side of the junction to the location of the centre of curvature of the first curved free edge portion 3133*b* of modified edge portion 3130, and the location of the centre of curvature of the first curved free edge portion 3143*b* of modified edge portion 3140. As such, the free edge 3133 of the modified edge portion 3130 has a substantially s-shaped profile. The substantially s-shaped profile extends from a third creasing line 3134 to the second creasing line 3132. The third creasing line 3134 is located between the first creasing line 3131 and the second creasing line 3132. The third creasing line 3134 is the closest creasing line of all the creasing lines in the modified edge portion 3130 to the first creasing line 3131. The tip of the third creasing line 3134 abuts the tip of the second ablated line 3142.

Figure 5:
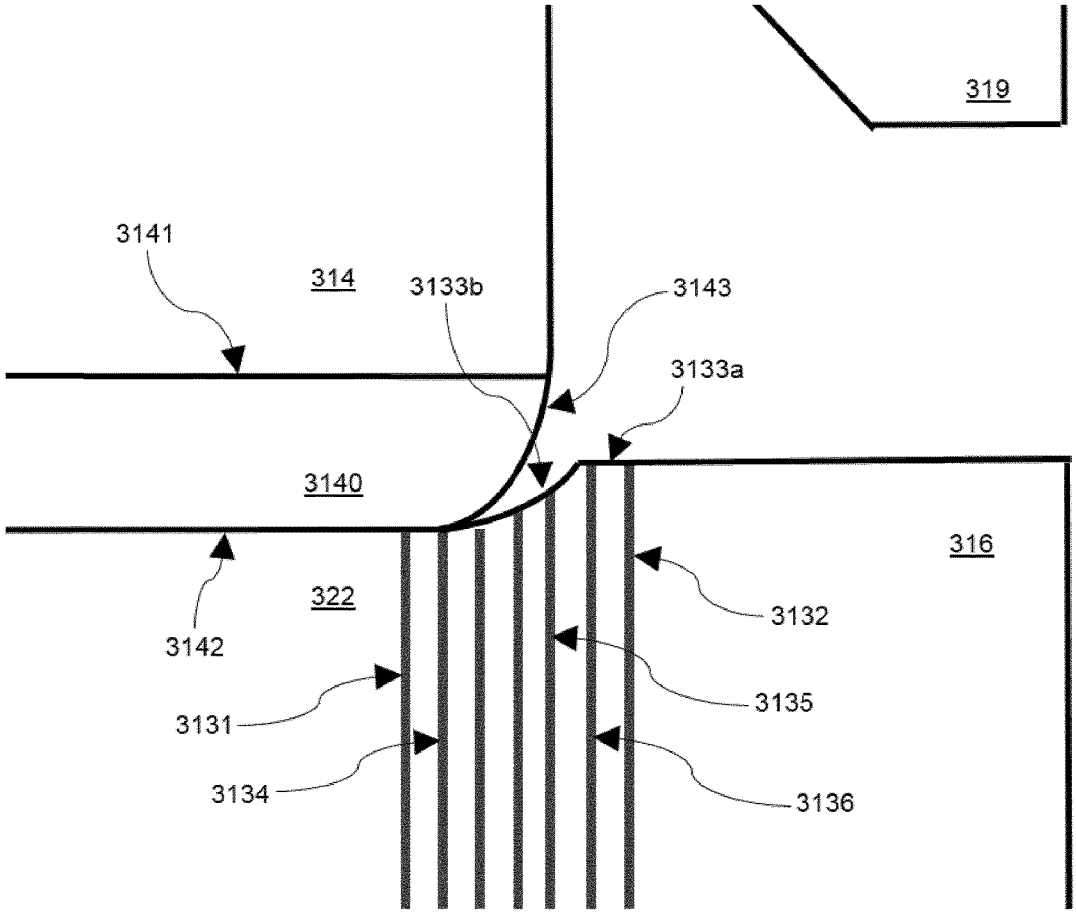
FIG. 5 shows a magnified view of a portion of a laminar blank for the manufacture of a container in accordance with a second embodiment of the present invention.

FIG. 5 shows a magnified view of a portion of a laminar blank 300A for the manufacture of a container in accordance with a second embodiment of the present invention. The magnified view of the portion of laminar blank 300A in FIG. 5, corresponds to the magnified view of the portion of laminar blank 300 in FIG. 4B. As shown in FIG. 5, the first ablated line 3141 is a straight line. The second ablated line 3142 is a straight line. The free edge 3143 of modified edge portion 3140 now consists of a curved profile that extends from the tip of the first ablated line 3141 to the tip of the second ablated line 3142.

The free edge 3133 of modified edge portion 3130 now has a curved free edge portion 3133*b* and a straight free edge portion 3133*a*. The curved free edge portion 3143*b* extends from the tip of the third creasing line 3134, and the straight free edge portion 3133*a* extends from the tip of the second creasing line 3142. The curved free edge portion 3133*b* adjoins the straight free edge portion 3133*a* at a point between the longitudinal position of a fourth creasing line 3135 and the longitudinal position of a fifth creasing line 3136.

It will be appreciated that the first ablated line 3141 could alternatively be in the form of a creasing line and the second ablated line 3142 could alternatively be in the form of a creasing line.

The invention claimed is:

1. A container for consumer articles, the container being at least partially formed from a laminar blank, the laminar blank defining a portion of the container, which comprises:

a first planar wall;

a second planar wall connected to the first planar wall by a first modified edge portion forming a bevelled edge portion of the container; and a third planar wall connected to the first planar wall by a second modified edge portion forming a curved edge portion of the container;

the longitudinal direction of the first modified edge portion being transverse to the longitudinal direction of the second modified edge portion; the first modified edge portion and the second modified edge portion forming, when the container is assembled from the laminar blank, adjacent edge portions of the container meeting at a junction;

wherein each of the first modified edge portion and the second modified edge portion has a length in the longitudinal direction of the respective modified edge portion and a respective width that extends transversely to the length;

wherein the first modified edge portion has a perimeter, the perimeter comprising:

a first line of weakness and a second line of weakness each extending in the longitudinal direction of the first modified edge portion, and a free edge extending between a tip of the first line of weakness and a tip of the second line of weakness at the junction with the second modified edge portion;

wherein the second modified edge portion has a perimeter, the perimeter comprising:

a first line of weakness and a second line of weakness each extending in the longitudinal direction of the second modified edge portion, and a free edge extending between the tip of the first line of weakness and the tip of the second line of weakness at the junction with the first modified edge portion; and wherein the free edge of at least one of the first modified edge portion and the second modified edge portion comprises a curved free edge portion and a straight free edge portion.

2. A container according to claim 1, wherein the free edge of the first modified edge portion comprises a curved free edge portion and a straight free edge portion.

3. A container according to claim 2, wherein the straight free edge portion extends from the first line of weakness of the first modified edge portion, and wherein the curved free edge portion extends from the straight free edge portion.

4. A container according to claim 2, wherein the first line of weakness of the first modified edge portion comprises a straight portion and a curved portion.

5. A container according claim 4, wherein the curved portion-of the first line of weakness defines the tip of the first line of weakness.

6. A container according to claim 2, wherein the free edge of the second modified edge portion has a substantially s-shaped profile.

7. A container according to claim 1, wherein the free edge of the second modified edge portion comprises a curved free edge portion and a straight free edge portion.

8. A container according to claim 7, wherein the straight free edge portion extends from the second line of weakness of the second modified edge portion, and wherein the curved free edge portion extends from the straight free edge portion.

9. A container according to claim 7, wherein each of the first line of weakness and the second line of weakness of the first modified edge portion is substantially straight.

10. A container according to claim 1, wherein the second modified edge portion further comprises a plurality of additional lines of weakness disposed between the first line of weakness and the second line of weakness of the second modified edge portion, the plurality of additional lines of weakness extending substantially in the longitudinal direction of the second modified edge portion.

11. A container according to claim 10, wherein the plurality of additional lines of weakness of the second modified edge portion comprise a third line of weakness, and wherein the free edge of the second modified edge portion extends from the third line of weakness.

12. A container according to claim 11, wherein the third line of weakness is disposed adjacent to the first line of weakness of the second modified edge portion.

13. A container according to claim 1, wherein the lines of weakness of the first modified edge portion are a plurality of ablated lines on the inner surface of said modified edge portion.

14. A container according to claim 1, wherein the lines of weakness of the second modified edge portion are a plurality of creasing lines in the laminar blank.

15. A laminar blank for forming a container for consumer articles, the laminar blank comprising:

a first planar wall;

a second planar wall connected to the first planar wall by a first modified edge portion forming a bevelled edge portion of the container; and a third planar wall connected to the first planar wall by a second modified edge portion forming a curved edge portion of the container;

the longitudinal direction of the first modified edge portion being transverse to the longitudinal direction of the second modified edge portion; the first modified edge portion and the second modified edge portion forming, when the container is assembled from the laminar blank, adjacent edge portions of the container meeting at a junction;

wherein each of the first modified edge portion and the second modified edge portion has a length in the longitudinal direction of the respective modified edge portion and a respective width that extends transversely to the length;

wherein the first modified edge portion has a perimeter, the perimeter comprising:

a first line of weakness and a second line of weakness each extending in the longitudinal direction of the first modified edge portion, and a free edge extending between a tip of the first line of weakness and a tip of the second line of weakness at the junction with the second modified edge portion;

wherein the second modified edge portion has a perimeter, the perimeter comprising:

a first line of weakness and a second line of weakness each extending in the longitudinal direction of the second modified edge portion, and a free edge extending between the tip of the first line of weakness and the tip of the second line of weakness at the junction with the first modified edge portion; and wherein the free edge of at least one of the first modified edge portion and the second modified edge portion comprises a curved free edge portion and a straight free edge portion.

* * * * *